US011670850B2

(12) United States Patent
Molla Aghajanzadeh et al.

(10) Patent No.: US 11,670,850 B2
(45) Date of Patent: Jun. 6, 2023

(54) METHOD AND APPARATUS FOR A HYBRID TIME DELAY/PHASE SHIFTER STRUCTURE FOR BEAM SQUINT MITIGATION IN WIDEBAND ANTENNA ARRAYS

(71) Applicant: HUAWEI TECHNOLOGIES CO., LTD., Shenzhen (CN)

(72) Inventors: Sahar Molla Aghajanzadeh, Kanata (CA); Samuel Alfred Tiller, Ottawa (CA); Ming Jian, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 109 days.

(21) Appl. No.: 17/217,182

(22) Filed: Mar. 30, 2021

(65) Prior Publication Data

US 2022/0320727 A1 Oct. 6, 2022

(51) Int. Cl.
*H01Q 3/26* (2006.01)

(52) U.S. Cl.
CPC ..... *H01Q 3/2694* (2013.01)

(58) Field of Classification Search
CPC ..... H01Q 3/2694; H01Q 1/28; H01Q 1/421
USPC ..... 342/372, 442, 375, 377
See application file for complete search history.

(56) References Cited

U.S. PATENT DOCUMENTS 4,743,914 A 5/1988 Schuss et al.
2020/0204244 A1* 6/2020 Hajimiri ..... H04B 7/0697

FOREIGN PATENT DOCUMENTS

CN 107528617 A 12/2017
WO 2014142885 A1 9/2014

OTHER PUBLICATIONS

Wang et al., "Wideband Channel Estimation for mmWave Massive MIMO Systems with Beam Squint Effect", 2018 IEEE Global Communications Conference (GLOBECOM), Dec. 2018, pp. 1-6.
Mailloux, R.J., "Array Error Effects", Phased Array Antenna Handbook, Second Edition, pp. 353-378, Artech House, Inc., 2005.
Mailloux, R.J., "Array Grating Lobes due to Periodic Phase, Amplitude, and Time Delay Quantization", IEEE Transactions on Antennas and Propagation, vol. AP-32, No. 12, Dec. 1984, pp. 1364-1368.
Kim et al., Hybrid Beamforming Architecture and Wide Bandwidth True-time Delay for Future high Speed Communications, 5G and beyond 5G Beamforming System, 2018 3rd International Conference on Integrated Circuits and Microsystems, pp. 331-335.

* cited by examiner

*Primary Examiner* — Bo Fan

(57) ABSTRACT

A method and apparatus for mitigating the beam squint effect in a wideband wireless communication device involving a phased antenna array. Time delay units are operated in series with phase shifters to apply phase shifts to signals fed to or received from antenna elements. The array may be subdivided into sub-arrays each associated with its own time delay unit, and with each antenna element associated with its own phase shifter. The phase shifters are operated to compensate for location mismatch between time delay units and antenna elements, and also to compensate for practical limitations of the time delay units, such as length and quantization limitations.

20 Claims, 14 Drawing Sheets

Array Power Versus Azimuth Angle for Maximum Operating Frequency (27.45GHz)

METHOD AND APPARATUS FOR A HYBRID TIME DELAY/PHASE SHIFTER STRUCTURE FOR BEAM SQUINT MITIGATION IN WIDEBAND ANTENNA ARRAYS

FIELD OF THE INVENTION

The present invention pertains to the field of network communications, and in particular, to beam squint mitigation in antenna arrays.

BACKGROUND

Phased array antennas are made up of multiple individual stationary antennas that are fed coherently to steer a beam to given elevation and azimuth angles in space. In order to steer a transmit beam, different antennas of the array are fed with different phase-shifted versions of a signal, in order to produce a suitable interference pattern. When the signal is relatively wideband, the use of phase shifters to produce the different phase-shifted versions of the signal results in a beam squint problem, in which the beam deviates from its desired direction in a frequency-dependent manner.

Time delay units can be implemented in place of phase shifters to resolve the beam squint problem. However, time delay units are relatively complex and expensive. In addition, as the size of a phased antenna array increases, the time delay required by time delay units can become large. Hybrid phased antenna array systems have been proposed, in which both time delay units and phase shifters are serially connected to antenna elements. However, such systems are still subject to improvement.

Accordingly, there is a need for a method and apparatus that at least partially addresses one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present disclosure is to provide a method, apparatus and controller for operating a phased antenna array. The method, apparatus and controller are implemented so as to mitigate beam squint. The phased array is operated using one or more time delay units and one or more phase shifters connected serially, in order to apply respective amounts of controllable time delay and controllable phase shift to signals. That is, signals are adjusted partially using time delay units and partially using phase shifters. In addition, the phase shifters are operated in a manner which accounts for the actual amount of time delay applied by a time delay unit which is in the same signal path. This can improve operation for example because limitations of the time delay unit can be compensated for by the phase shifter. Such limitations can include quantization limitations, limitations on the maximum achievable amount of time delay, or a combination thereof.

In accordance with a first embodiment of the present disclosure, there is provided an apparatus facilitating beamforming. The apparatus may operate in order to mitigate beam squint, for example in a wideband wireless communication device. The apparatus includes one or more time delay units each configured to apply a respective controllable amount of time delay to signals provided. The apparatus also includes one or more phase shifters each operatively coupled between a corresponding time delay unit and a respective antenna element of an antenna array. Each of the phase shifters is configured to apply a respective controllable amount of phase shift to signals received from one of the time delay units (for transmit operation) or received from the respective antenna element (for receive operation). In some embodiments the apparatus can perform transmission. In some embodiments the apparatus can perform reception. In some embodiments the apparatus can perform both transmission and reception. Each of the phase shifters is set with the controllable amount of phase shift to account for the respective controllable amount of time delay that is actually applied by one of the time delay units. A technical effect is that limitations of the time delay units are at least partially compensated for by the phase shifters.

In accordance with a second embodiment of the present disclosure, there is provided a controller facilitating beamforming in a wireless communication device. The controller comprises one or more electronic components, such as digital or analog control components, digital-to-analog converters, voltage or current drivers, etc. These electronic components are configured to cause one or more time delay units to apply a respective controllable amount of time delay to signals provided to the time delay unit. The electronic components also configured to cause one or more phase shifters, each operatively coupled between a corresponding time delay unit and a respective antenna element of an antenna array, to apply a respective controllable amount of phase shift to signals received from one of the time delay units or received from the respective antenna element. The controller is configured to set the controllable amount of phase shift to account for respective controllable amount of time delay actually applied by the corresponding time delay units. A technical effect is that the controller controls the time delays and phase shifts applied by each time delay unit and phase shifter, such that limitations of the time delay units are at least partially compensated for by the phase shifters.

In accordance with a third embodiment of the present disclosure, there is provided a method for controlling or operating wireless communication device. The method includes causing one or more time delay units to apply a respective controllable amount of time delay to signals provided to the time delay unit. The method further includes causing one or more phase shifters, each operatively coupled between a corresponding time delay unit and a respective antenna element of an antenna array, to apply a respective controllable amount of phase shift to signals received from a time delay unit or received from the respective antenna element. Each of the phase shifters are set with a controllable amount of phase shift which accounts for the respective controllable amount of time delay that is actually applied by a corresponding time delay unit. A technical effect is that the time delays and phase shifts are applied by each time delay unit and phase shifter, such that limitations of the time delay units are at least partially compensated for by the phase shifters. The method can further include operating the time delay units and the phase shifters to apply time delays, and phase shifts, respectively, to signals.

In various embodiments, the actually applied controllable amount of time delay is an achievable approximation of an ideal target amount of time delay. In some further embodiments, the achievable approximation differs from the ideal target amount of time delay due at least in part to the time delay unit only being capable of applying time delays between a predetermined maximum amount and a predetermined minimum amount. In such cases the ideal target amount of time delay is greater than the predetermined maximum amount or less than the predetermined minimum amount. In some further embodiments, the achievable approximation differs from the ideal target amount of time delay due at least in part to the time delay unit only being capable of applying time delays belonging to a predetermined discrete, quantized set. In such cases the ideal target amount of time delay is a value not belonging to the discrete, quantized set.

In some embodiments, the above-mentioned apparatus further includes a controller configured to determine the above-mentioned achievable approximation by corresponding processing of the ideal target amount of time delay based on one or more limitations of the time delay unit. The controller is further configured to control the controllable amounts of time delay of the one or more time delay units and to control the controllable amounts of phase shift of the one or more phase shifters.

Embodiments have been described above in conjunction with aspects of the present disclosure upon which they can be implemented. Those skilled in the art will appreciate that embodiments may be implemented in conjunction with the aspect with which they are described, but may also be implemented with other embodiments of that aspect. When embodiments are mutually exclusive, or are otherwise incompatible with each other, it will be apparent to those skilled in the art. Some embodiments may be described in relation to one aspect, but may also be applicable to other aspects, as will be apparent to those of skill in the art.

BRIEF DESCRIPTION OF THE FIGURES

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
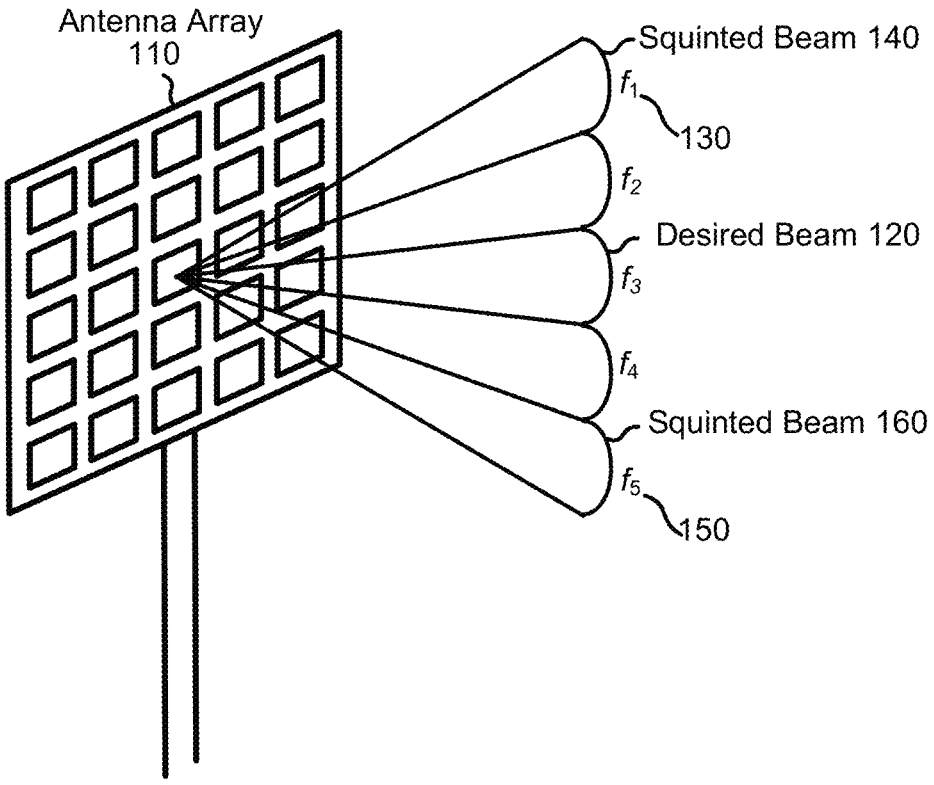
FIG. 1 illustrates a large antenna array and the problem of beam squint associated with beamforming involving a wideband signal, in accordance with the prior art.

Beam squint related to wireless communication devices, particularly those using phased array antennas, occurs when a formed beam varies in direction as a function of operating frequency. Beam squint is an important issue because it can reduce the phased array's bandwidth and can also result in power loss. FIG. 1 illustrates beam squint for a large antenna array 110, where due to the frequency dependent change in beam direction, maximum frequency $f_1$ 130 and minimum frequency $f_5$ 150 results in squinted beams 140 and 160, respectively, being offset from desired beam 120.

According to embodiments of the present invention, a phased antenna array, such as a Uniform Rectangular Array (URA), can be operated using a combination of both time delay units (TDUs) and phase shifters (PS). In an embodiment, a URA can include N antenna elements with even grid spacing. These N antenna elements can be located on a y-z plane with boresight in the direction of the x-axis. The antenna array can be subdivided into M sub-arrays of antenna elements (where the sum of antenna elements included in all M sub-arrays can equal N antenna elements). Each of the M sub-arrays can be associated with a TDU and each antenna element can be associated with a PS. Therefore, in the case of transmitting a signal from the antenna array, the signal is fed to each TDU associated with each sub-array. Each TDU applies a time delay and feeds its output toward a plurality of phase shifters, each being associated with (and typically co-located with) a corresponding antenna element of a corresponding sub-array. Each phase shifter applies a further phase shift. The combination of the time delays and phase shifts being applied is configured to implement a desired beamforming. In the case of receiving a signal, the signal flow is reversed but the implemented time delays and phase shifts remain the same. The use of TDUs in place of phase shifters is known to mitigate beam squint; the use of TDUs in combination with phase shifters can mitigate beam squint to a lesser extent, but with the advantage that fewer TDUs are required.

According to some embodiments, the phase shift value required at PS ($\phi_i^{(PS)}$) associated with the $i^{th}$ antenna element belonging to the $m^{th}$ sub-array of an antenna array can be determined using a three-step approach. The first step can include calculating the ideal phase shift value for the antenna element ($\phi_i^{(Ideal,f_0)}$) at a design frequency ($f_0$) of the array. The second step can include calculating the phase shift value being (or to be) implemented by the TDU ($\phi_m^{(TD,f_0)}$) associated with the $m^{th}$ sub-array, at $f_0$. The third step can include calculating the phase shift $\phi_i^{(PS)}$ to be applied by the phase shifter associated with the $i^{th}$ antenna element, by subtracting $\phi_m^{TD,f_0)}$ from $\phi_i^{(Ideal,f_0)}$. It should be appreciated that the phase shifts calculated for the array's PS using this procedure remains constant for the whole band of frequencies transmitted/received by the array. However, the phase shifts produced by TDUs change according to operating frequency (f) when f can be different from $f_0$.

In the URA case, by way of example, the ideal phase shift applied at each antenna element i of the array, at design frequency $f_0$, in order to steer a beam to given elevation ($\theta_0$) and azimuth ($\varphi_0$) angle in space, can be given by:

$$\phi_i^{(Ideal,f_0)} = \frac{2\pi f_0}{c}(z_i\sin\theta_0 + y_i\sin\varphi_0\cos\theta_0),\ i \in \{1, \ldots, N\} \tag{1}$$

where ($y_i$, $z_i$) indicates, in rectangular coordinates on the y-z plane, the location of antenna element i.

The ideal value of the time delay applied by the TDU associated with the $m^{th}$ sub-array, denoted $TDU_m$, can be given by (where of the coordinate of $TDU_m$ corresponding to sub-array m on the y-z plane is ($y'_m$, $z'_m$) $m\varepsilon\{1, \ldots, M\}$,):

$$\tau_m = \frac{z'_m\sin\theta_0}{c} + \frac{y'_m\sin\varphi_0\cos\theta_0}{c},\ m \in \{1, \ldots, M\} \tag{2}$$

However, TDUs are not ideal components. In practice, the amount of time delay actually applied by a TDU is an achievable approximation of the time delay given in Equation (2). The term $\tilde{\tau}_m$ is used herein to refer to such an achievable approximation. The value $\tilde{\tau}_m$ can differ from $\tau_m$ due to one or more factors. For example, a TDU can achieve time delays by propagating signals along various lengths of delay line—however the maximum length of such delay lines, and hence the maximum achievable delay, is limited. One reason for this is that long-length TDUs typically exhibit excessive insertion loss, which should be avoided. Therefore, one source of difference between $\tilde{\tau}_m$ and $\tau_m$ is due to the time delay unit only being capable of applying time delays between a predetermined maximum amount and a predetermined minimum amount. As another example, a TDU may only be capable of implementing a limited number of different discrete delays. This can be due to the presence of finite number of combinations of delay line paths, due to the use of digital control allowing only a finite number of combinations of delay line paths, or a combination thereof. This limitation is referred to as quantization and reflects the fact that the time delay unit is only capable of applying time delays belonging to a predetermined discrete, quantized set. In various embodiments, and by way of example, $\tilde{\tau}_m = \lfloor \tau_m \rfloor_q$ can be used, where the floor function denotes the maximum achievable delay is limited, and the subscript q denotes that the achievable time delays are quantized. In view of the above, $\tilde{\tau}_m$ can be expressed as:

$$\tilde{\tau}_m \tau_m + e_m, m\varepsilon\{1, \ldots, M\} \tag{3}$$

where $e_m$ is the error that can be caused, for example, by the length limitations and quantization limitations of the $TDU_m$.

In order to implement, as best as possible, the phase shift prescribed in Equation (1) at antenna element i, embodiments of the present invention are operated to apply phase shift, at the phase shifter associated with antenna element i (denoted $PS_i$), as follows. The phase shift of $PS_i$ at antenna element i, belonging to sub-array m, is be given by:

$$\phi_i^{(PS)} = \phi_i^{(Ideal,f_0)}, i\varepsilon\{1, \ldots N\}, m\varepsilon\{1, \ldots, M\} \tag{4}$$

where the phase shift produced by the TDU with compensation value $\tilde{\tau}_m$ at $f_0$ is given by $\phi_m^{(TD,f_0)} = 2\pi f_0 \tilde{\tau}_m$. In other words, the phase shifter $PS_i$ is operated to apply a phase shift which is the difference between the ideal target amount of phase shift and the amount of phase shift already effectively implemented by operation of the associated TDU.

Accordingly, the amount of phase shift may be set based on a combination of a first term and a second term. The first term is set based in part on a physical location of the respective antenna element coupled to the phase shifter (see Equation (1)), and the second term is set to compensate for the controllable amount of time delay $\tilde{\tau}_m$ as actually applied by a time delay unit.

In even more detail, in various embodiments, for each time delay unit, time delay is set based on a physical location of that time delay unit in combination with a target beamsteering angle of the wireless communication device (see Equation (2)). For each of the phase shifters, phase shift is set based on a physical location of the phase shifter in combination with the target beamsteering angle, further in combination with a design frequency of the wireless communication device, and further in combination with the respective controllable amount of time delay as actually applied by one of the time delay units (see Equations (1) and (4)).

Thus, the phase shifters are controlled based on a location mismatch as well as non-ideality of the time delay units. Notably, according to embodiments of the present invention, the same phase shifter is operated to compensate for both of these features, namely the location mismatch between time delay unit and antenna element, and the time delay unit non-ideality. As such, the same phase shifter performs multiple functions at once, thereby improving operation without requiring additional components such as additional phase shifters.

Using the phase shift of PS, in Equation (4), the total phase shift of antenna element i at frequency f (where $f_{min} \le f \le f_{max}$), is given by:

$$\phi_i^{(Total,f)} = \phi_i^{(PS} + \phi_m^{(TD,f)}, i\varepsilon\{1, \ldots, N\}, m\varepsilon\{1, \ldots, M\} \tag{5}$$

where the phase shift produced by the TDU by implementing time delay $\tilde{\tau}_m$ at f is given by $\phi_m^{(TD,f)} = 2\pi f \tilde{\tau}_m$.

It is noted that, although implementation using a URA is described above, embodiments of the present invention can be similarly implemented for other antenna array configurations, for example arrays having different shapes or spacings, including a variety of tiled sub-array shapes.

Figure 2A:
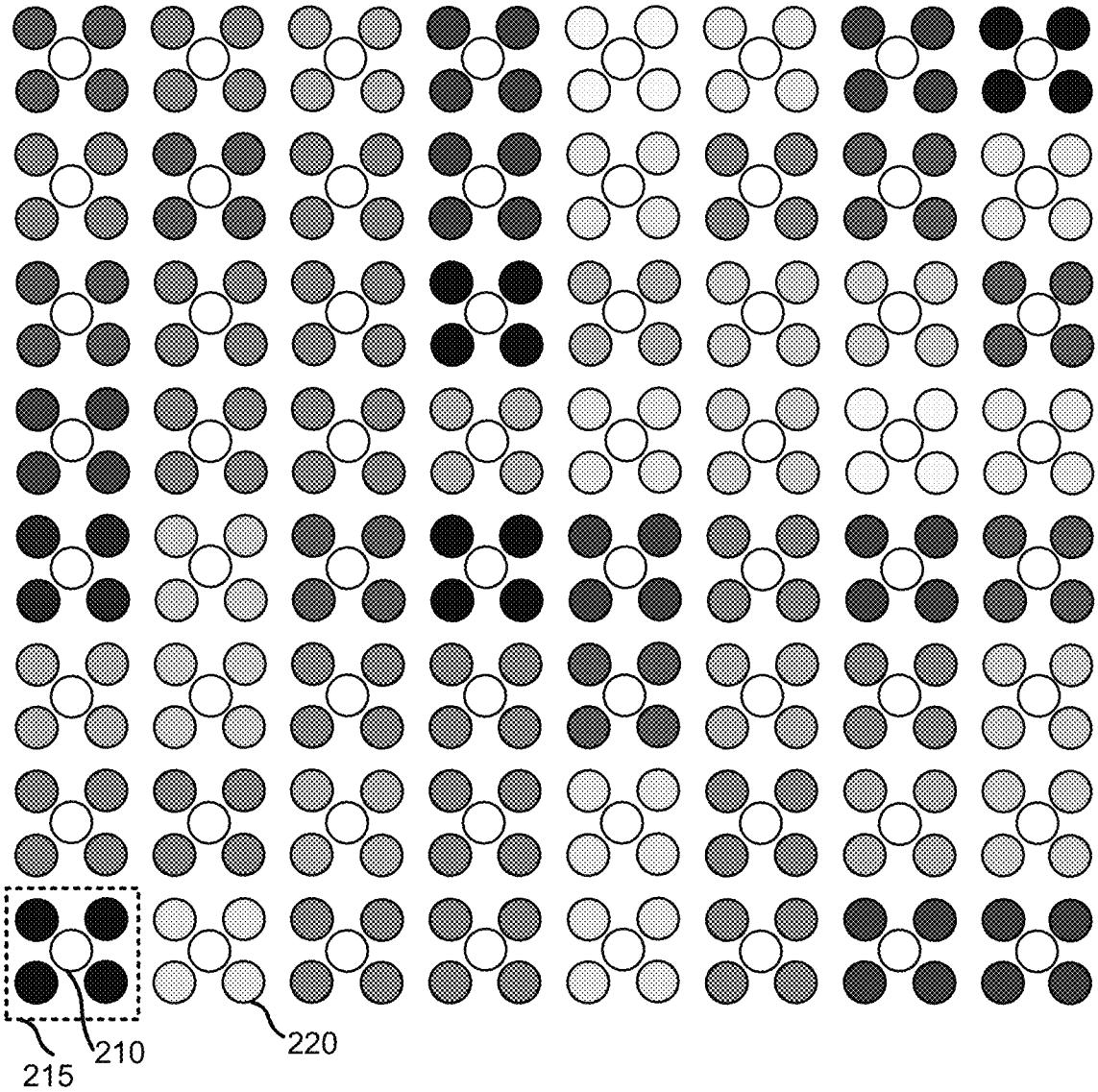
FIG. 2A illustrates a 16×16 uniform rectangular array (URA) antenna having multiple 2×2 square regular sub-arrays, according to an embodiment of the present disclosure.

An embodiment of a 16×16 URA with 3.2 GHz bandwidth and design frequency $f_0$=25.85 GHz is illustrated by FIG. 2A. FIG. 2A also illustrates the URA tiled with 2×2 square sub-arrays, and as previously disclosed, can include a combination of TDUs and PSs operating together to implement required phase shifts for the array. The TDUs can be located at the center of each 2×2 sub-array, at the sub-array inputs, which are denoted using empty circles. An example sub-array input and TDU location 210 is shown for sub-array 215. The filled circles represent antenna element locations, which may also correspond to phase shifter locations. An example antenna element location 220 is shown. Different 2×2 square sub-arrays are illustrated with different levels of shading. The URA in this embodiment may be configured, for example, to steer a beam to elevation $\theta_0$=30° and azimuth $\varphi_0$=60° for all frequencies in a given frequency band.

Figure 3A:
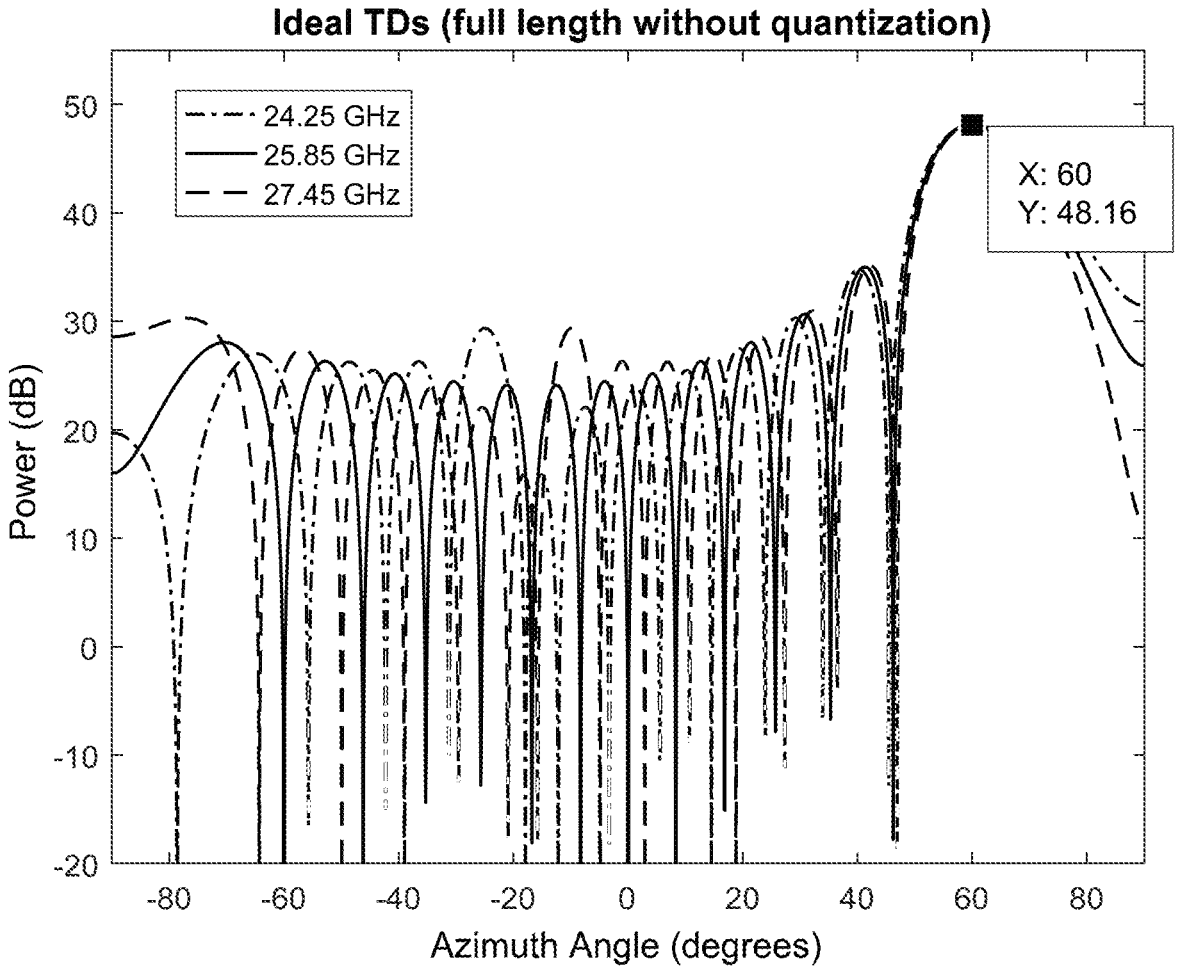
FIG. 3A illustrates, as a basis for comparison, antenna array beam patterns at different frequencies, for the antenna array of FIG. 2A, for the hypothetical case where time delay units are ideal without length (maximum achievable time delay) limitations or quantization limitations.
Figure 3B:
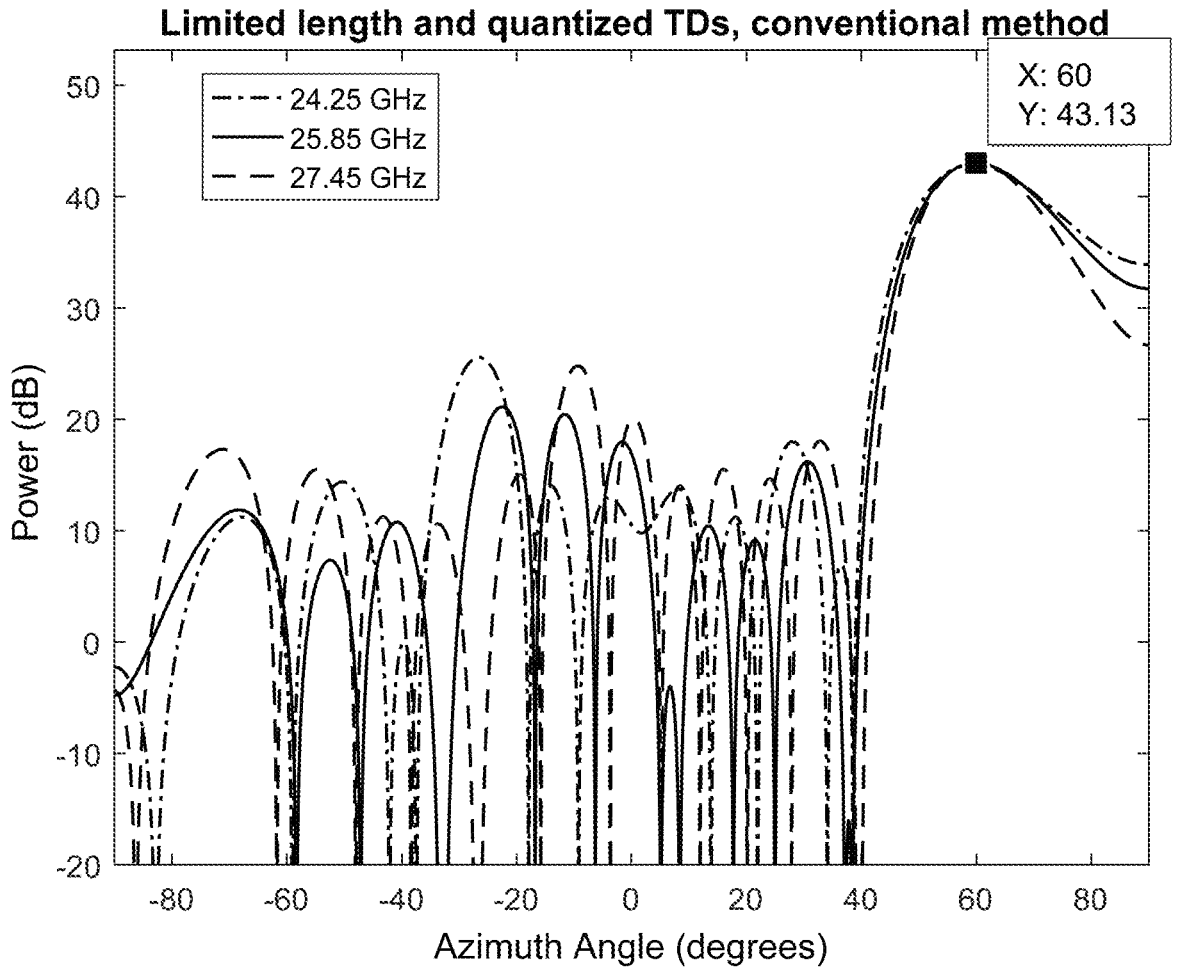
FIG. 3B illustrates, as another basis for comparison, antenna array beam patterns at different frequencies, for the antenna array of FIG. 2A, for the case where time delay units are limited with respect to both maximum achievable time delay and quantization levels, and where the phase shifters are not set to compensate for the time delays as actually applied.
Figure 3C:
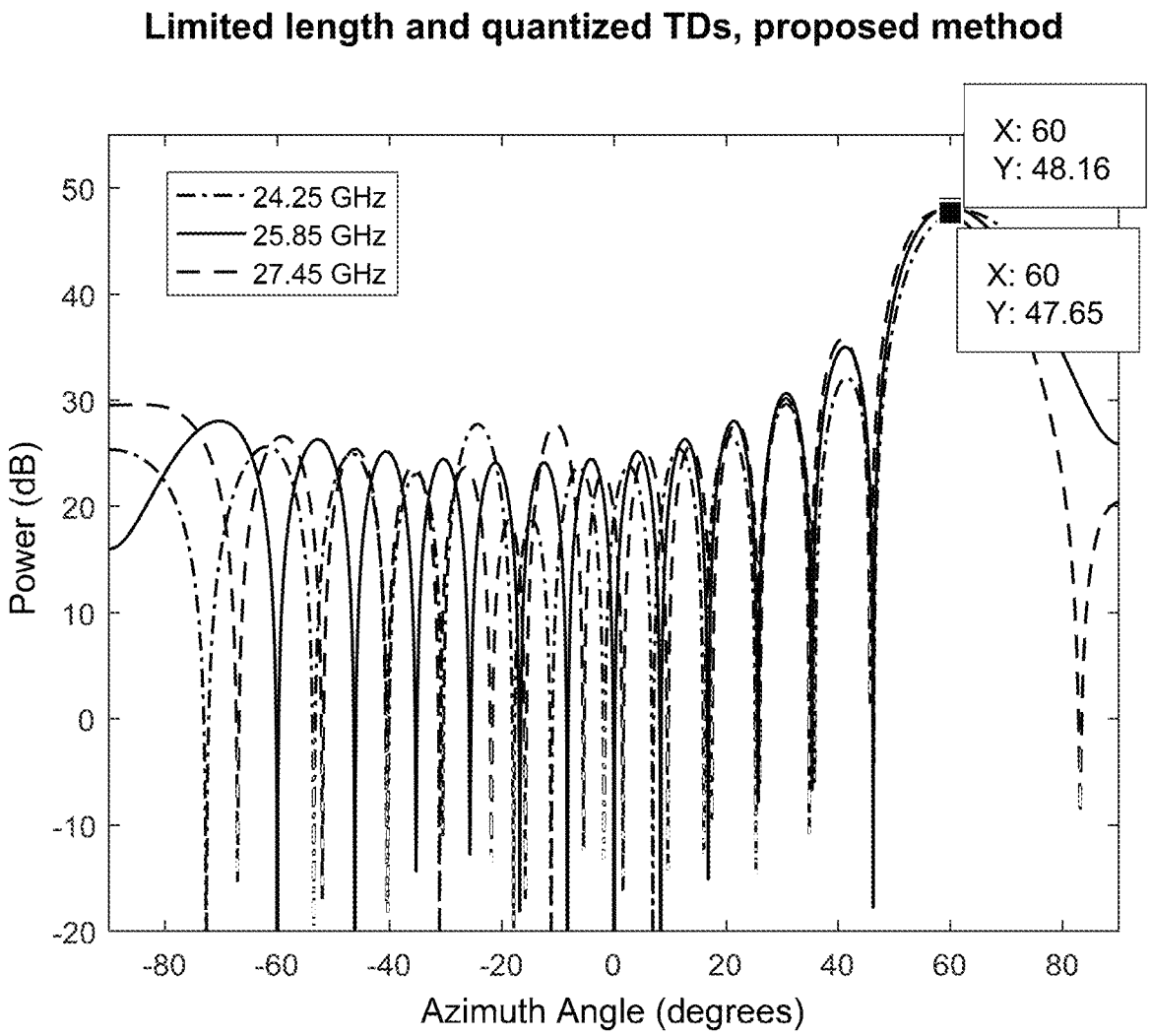
FIG. 3C illustrates antenna array beam patterns at different frequencies, for the antenna array of FIG. 2A, for the case where time delay units are limited with respect to both maximum achievable time delay and quantization levels, and where the phase shifters are set to compensate for the time delays as actually applied, in accordance with the present invention.

FIGS. 3A to 3C illustrates graphs of azimuth cut ($\theta_0$=30° of a power pattern of the array as a function of azimuth angle ($\varphi$) in degrees for the URA illustrated in FIG. 2A.

FIG. 3A illustrates, as a basis for comparison, antenna array beam patterns at different frequencies, for the antenna array of FIG. 2A, for the hypothetical case where time delay units are ideal without length (maximum achievable time delay) limitations or quantization limitations. In other words, the TDUs are capable of delivering delays within a full required range of (+/−145 ps). Beam patterns at frequencies of $f_{min}$=24.25 GHz, $f_0$=25.85 GHz, and $f_{max}$=27.45 GHz are shown. When the antenna array is operated to steer a beam toward 60° azimuth and 30° elevation, the achieved power level is 48.16 dB.

FIG. 3B illustrates, as another basis for comparison, antenna array beam patterns at different frequencies, for the antenna array of FIG. 2A, for the case where time delay units are limited with respect to both maximum achievable time delay and quantization levels, and where the phase shifters are not set to compensate for the time delays as actually applied. In other words, TDUs are subject to length and quantization limitations, but the phase shifters operate as if the TDUs are applying delays $\tau_m$ rather than $\tilde{\tau}_m$. For example, this may correspond, in Equation (4), to taking $\phi_m^{(TD,f_0)}=2\pi f_0\tau_m$. Beam patterns at frequencies of $f_{min}$=24.25 GHz, $f_0$=25.85 GHz, and $f_{max}$=27.45 GHz are shown. When the antenna array is operated to steer a beam toward 60 degree Azimuth and 30° elevation, the achieved power level is 43.13 dB, which is 5 dB less than the ideal case illustrated in FIG. 3A.

FIG. 3C illustrates antenna array beam patterns at different frequencies, for the antenna array of FIG. 2A, for the case where time delay units are limited with respect to both maximum achievable time delay and quantization levels, and where the phase shifters are set to compensate for the time delays as actually applied, in accordance with the present invention, for example according to Equation (4). Beam patterns at frequencies of $f_{min}$=24.25 GHz, $f_0$=25.85 GHz, and $f_{max}$=27.45 GHz are shown. When the antenna array is operated to steer a beam toward 60° azimuth and 30° elevation, the achieved power level is, at minimum, 47.65 dB, which is only 0.51 dB less than the ideal case illustrated in FIG. 3A, and which is significantly greater than the case illustrated in FIG. 3B.

As will be readily understood by a person skilled in the art, quantization lobes can occur due to time delay quantization introduced by TDUs and phase shift quantization generated by digital phase shifters. However, quantization lobes created by a TDU and the quantization lobes created by a PS are different than the spatial quantization lobes which result from the sub-array layout in a hybrid TD/PS structure as disclosed herein. Therefore, it should be appreciated that these spatial quantization lobes are, in accordance with current conventional understanding, an unavoidable characteristic of the hybrid TD/PS structure.

In an embodiment, the maximum length of TDUs can be limited to +/−1.75 T=+/−67.7 ps (where T=1/$f_0$). Also, a 4-bit quantizer with 0.25 T resolution can be used to quantize the TDU's values.

FIG. 3B further illustrates how failing to set phase shifter values based on time delays as actually applied can cause a pointing error and as a result, considerable power loss (approximately 5 dB). The power loss design frequency $f_0$ is also approximately 5 dB. However, as FIG. 3C illustrates, substantially no power loss is experienced at design frequency $f_0$ and power loss at $f_{min}$ and $f_{max}$ is only 0.5 dB. The improvement illustrated by FIG. 3C can be due to use of the disclosed approach that determines PS values based on time delays as actually applied, and that can allow for compensation of limited length TDUs and also quantized TDU values.

Figure 2B:
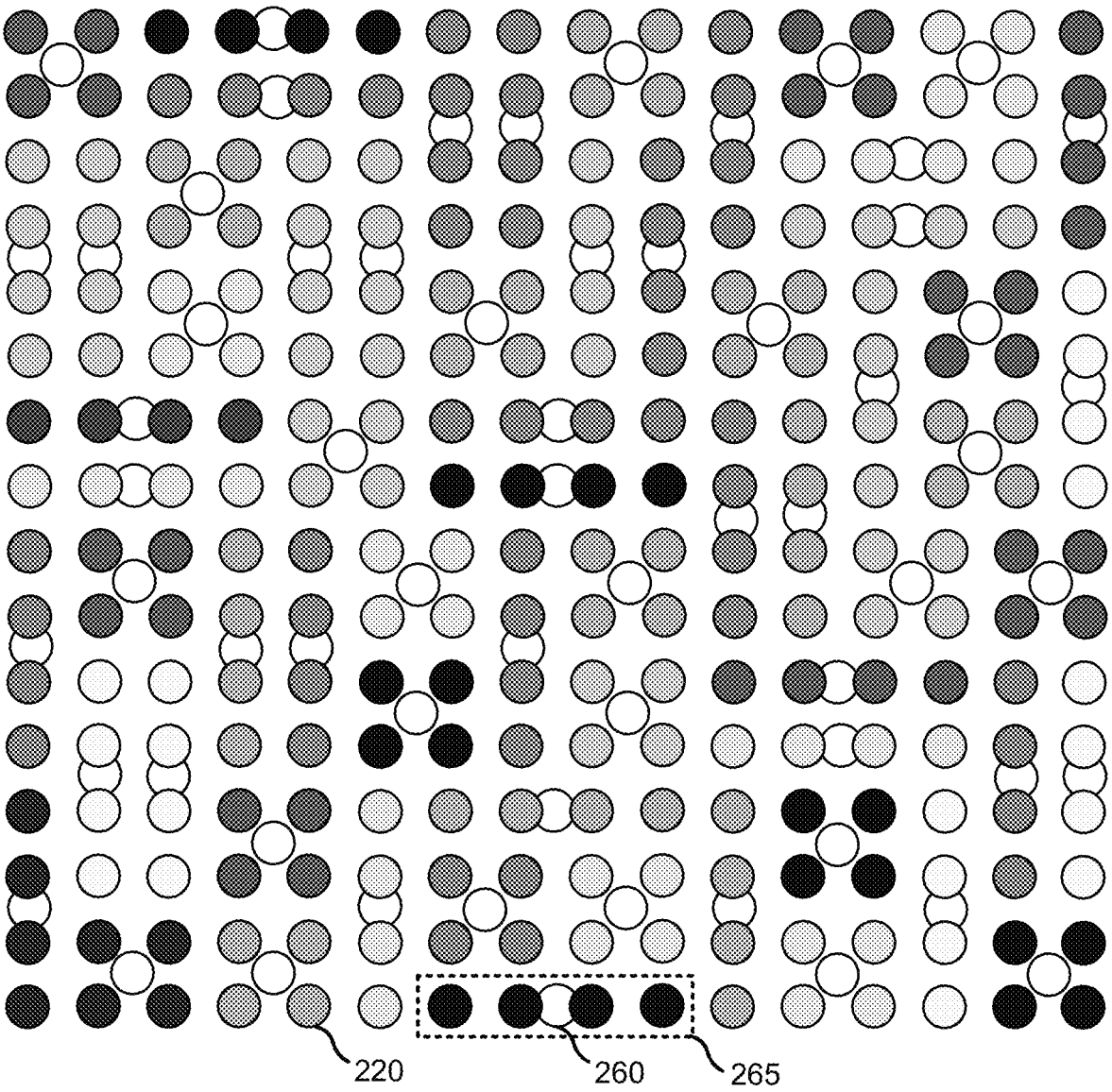
FIG. 2B illustrates a 16×16 URA antenna having multiple four-element sub-arrays arranged in an irregular structure, according to an embodiment of the present disclosure.

FIG. 2B illustrates an irregular sub-array structure using TDUs and PS where the array can be tiled irregularly (e.g. arbitrarily or randomly) with a combination of 2×2 square sub-arrays, 1×4 uniform linear sub-arrays, and 4×1 uniform linear sub-arrays. A potential advantage of URAs composed of an irregular combination of sub-array structures is a reduction in quantization lobes. Similarly to FIG. 2A, The TDUs can be located at the center of each sub-array, at the sub-array inputs, which are denoted using empty circles. An example sub-array input and TDU location 260 is shown for sub-array 265. The filled circles represent antenna element locations, which may also correspond to phase shifter locations. An example antenna element location 220 is shown. Different sub-arrays are illustrated with different levels of shading.

As FIG. 2B illustrates, the distance between sub-array inputs (indicated by empty circles) are not equal as they were by FIG. 2A. This difference in sub-array input distance can result in a reduction of quantization lobe level.

Figure 4A:
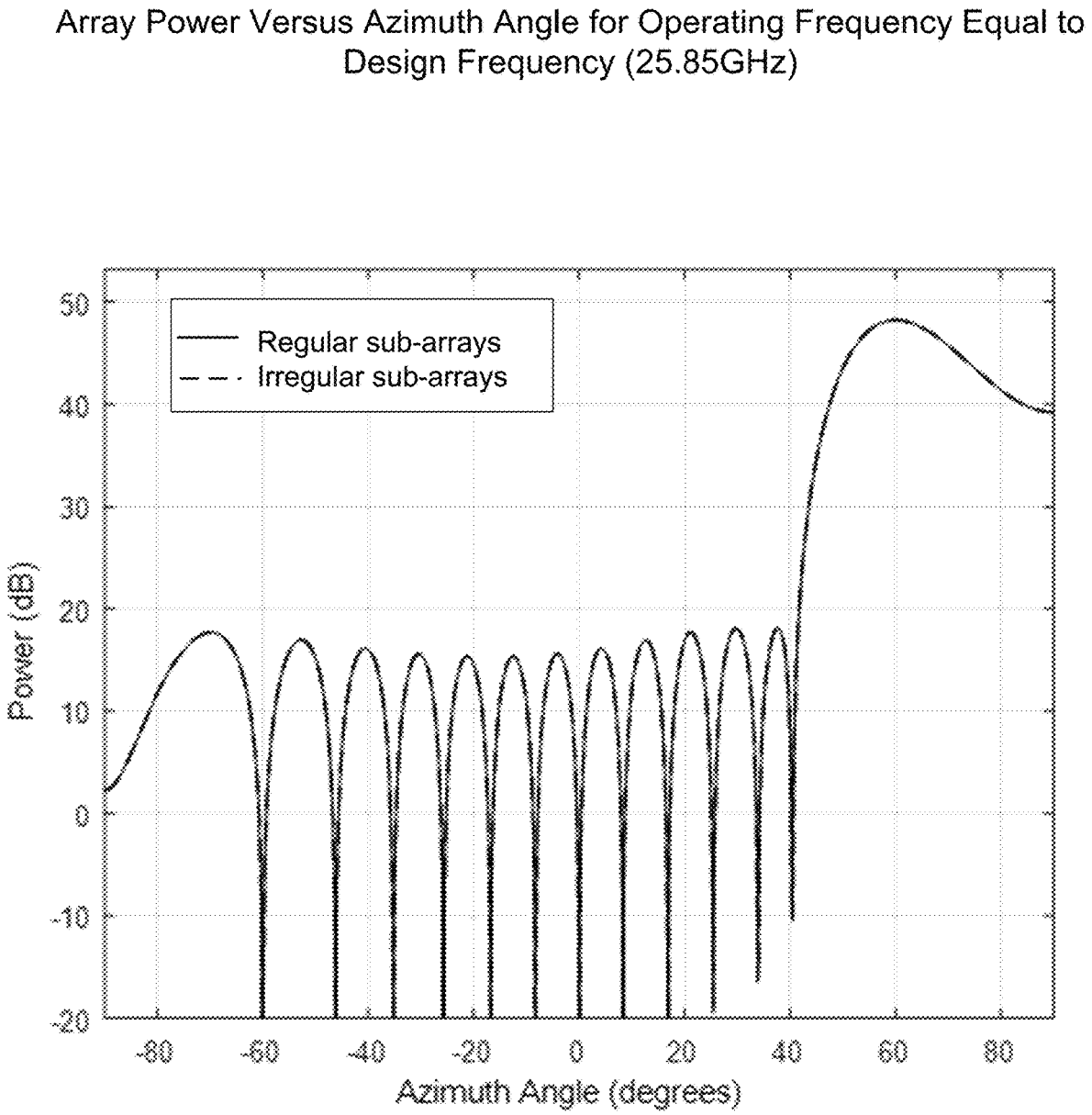
FIG. 4A illustrates antenna array beam patterns at a design frequency, for both the antenna arrays of FIG. 2A and FIG. 2B.
Figure 4B:
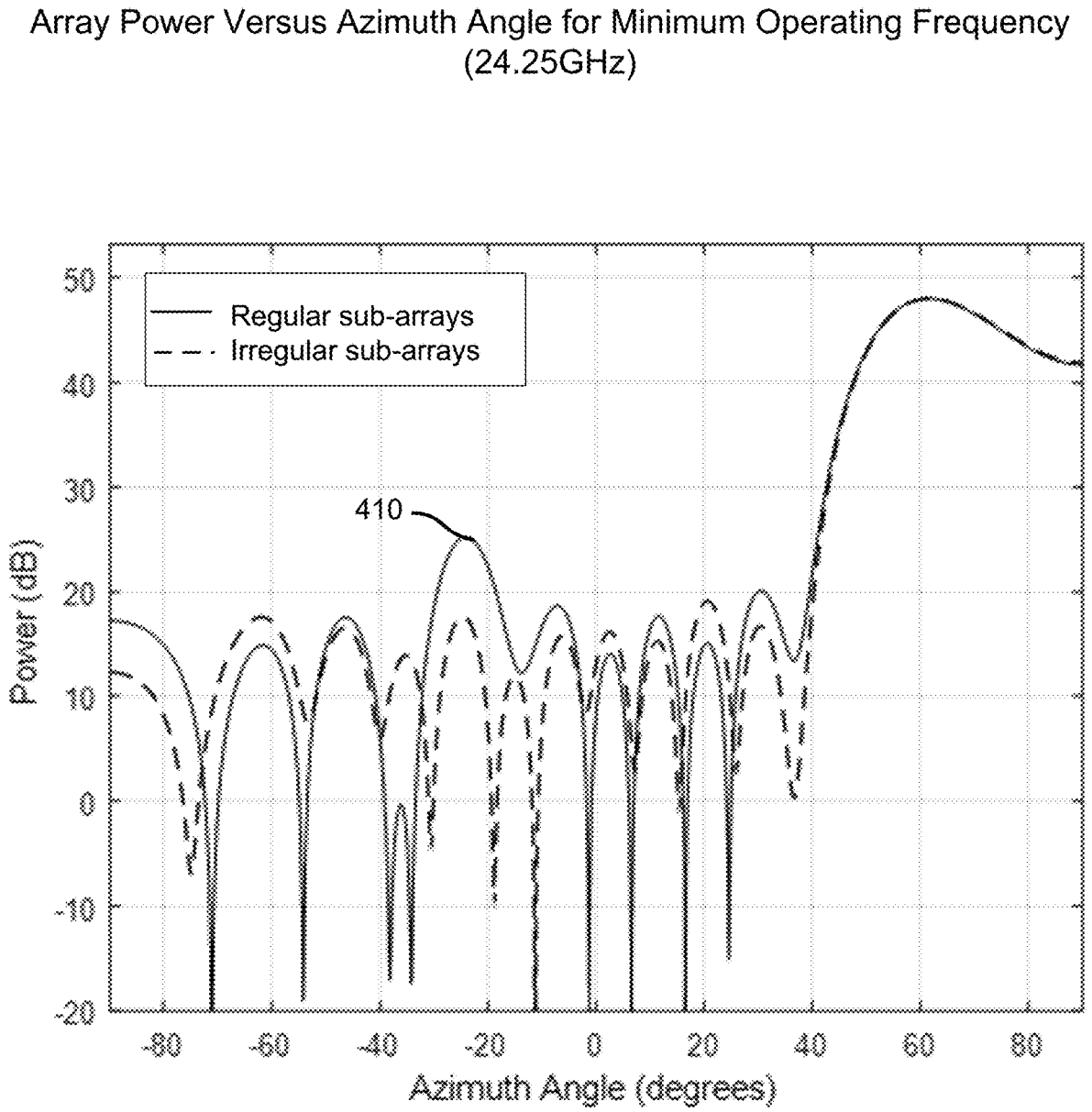
FIG. 4B illustrates antenna array beam patterns at a designated operating frequency $f_{min}$ lower than the design frequency, for both the antenna arrays of FIG. 2A and FIG. 2B, in order to exhibit sidelobe mitigation with respect to the antenna array of FIG. 2B.
Figure 4C:
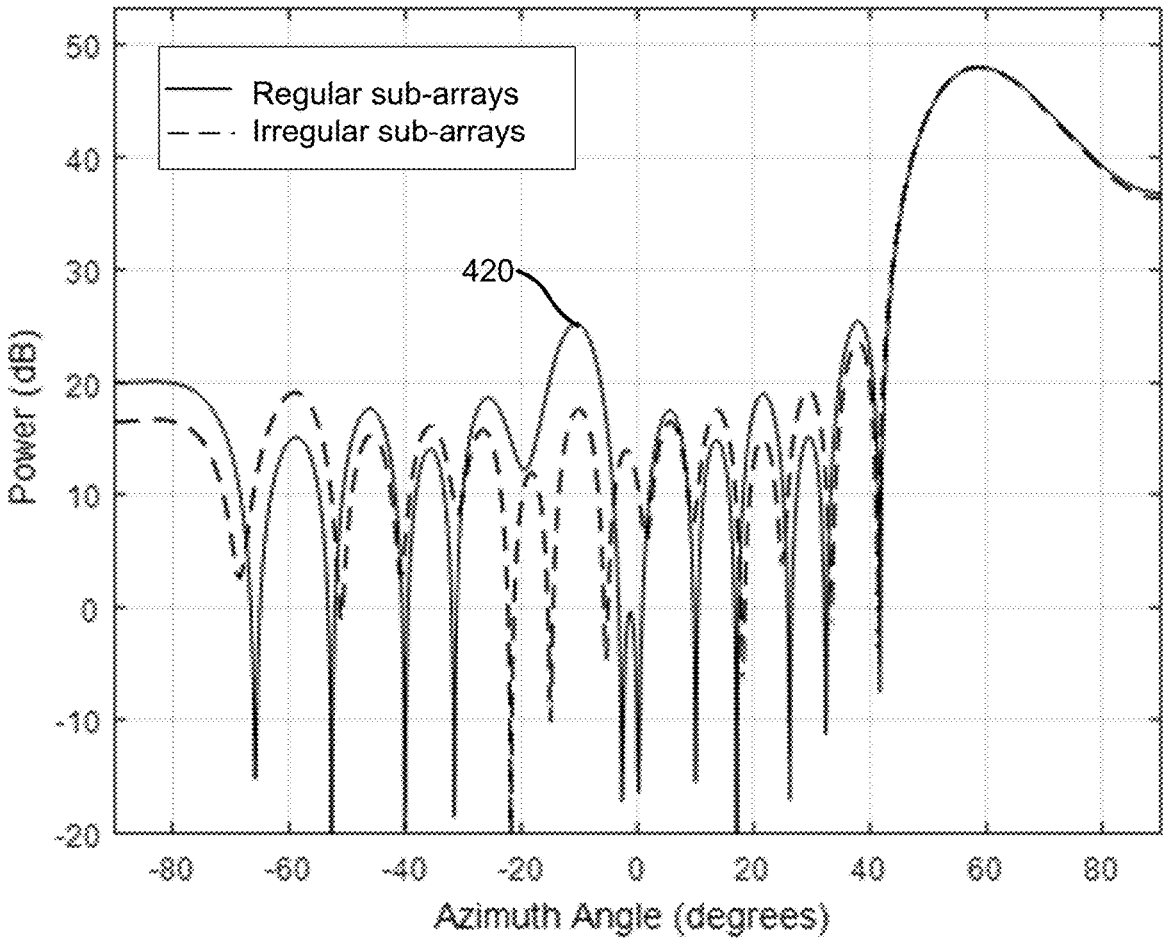
FIG. 4C illustrates antenna array beam patterns at a designated operating frequency $f_{max}$ higher than the design frequency, for both the antenna arrays of FIG. 2A and FIG. 2B, in order to exhibit sidelobe mitigation with respect to the antenna array of FIG. 2B.

FIGS. 4A to 4C illustrate radiated power versus azimuth angle ($\varphi$) in degrees for both the regular sub-array structure illustrated by FIG. 2A and the irregular sub-array structure illustrated by FIG. 2B. For purposes of this illustration, a −30 dB Taylor taper has been used to reduce side lobe levels. FIG. 4A illustrates radiated power for both the regular sub-array structure (of FIG. 2A) and the irregular sub-array structure (of FIG. 2B) at a design frequency $f_0$=25.85 GHz. FIG. 4B illustrates radiated power for both the regular sub-array and irregular sub-array structures at frequency $f_{min}$=24.25 GHz. FIG. 4C illustrates radiated power for both the regular sub-array and irregular sub-array structures at frequency $f_{max}$=27.45 GHz. The maximum length of TDUs in FIG. 4 was limited to +/−67.7 ps and a 4-bit quantizer was used to quantize TDU's values. For clarity, in FIGS. 4A, 4B and 4C the solid line represents radiated power for the regular sub-array case and the dashed line represents radiated power for the irregular sub-array case, noting that the two lines substantially overlap in FIG. 4A.

As FIGS. 4A to 4C illustrate, the use of an irregular sub-array structure in association with embodiments of the present invention can result in considerable improvement in quantization lobes (7.5 dB) at off-design frequencies, substantially without extra power loss at the desired steering angle. For example, at off-design frequencies, the large side lobes 410 and 420, which are present when using the regular sub-array structure, are reduced when using the irregular sub-array structure.

Figure 5:
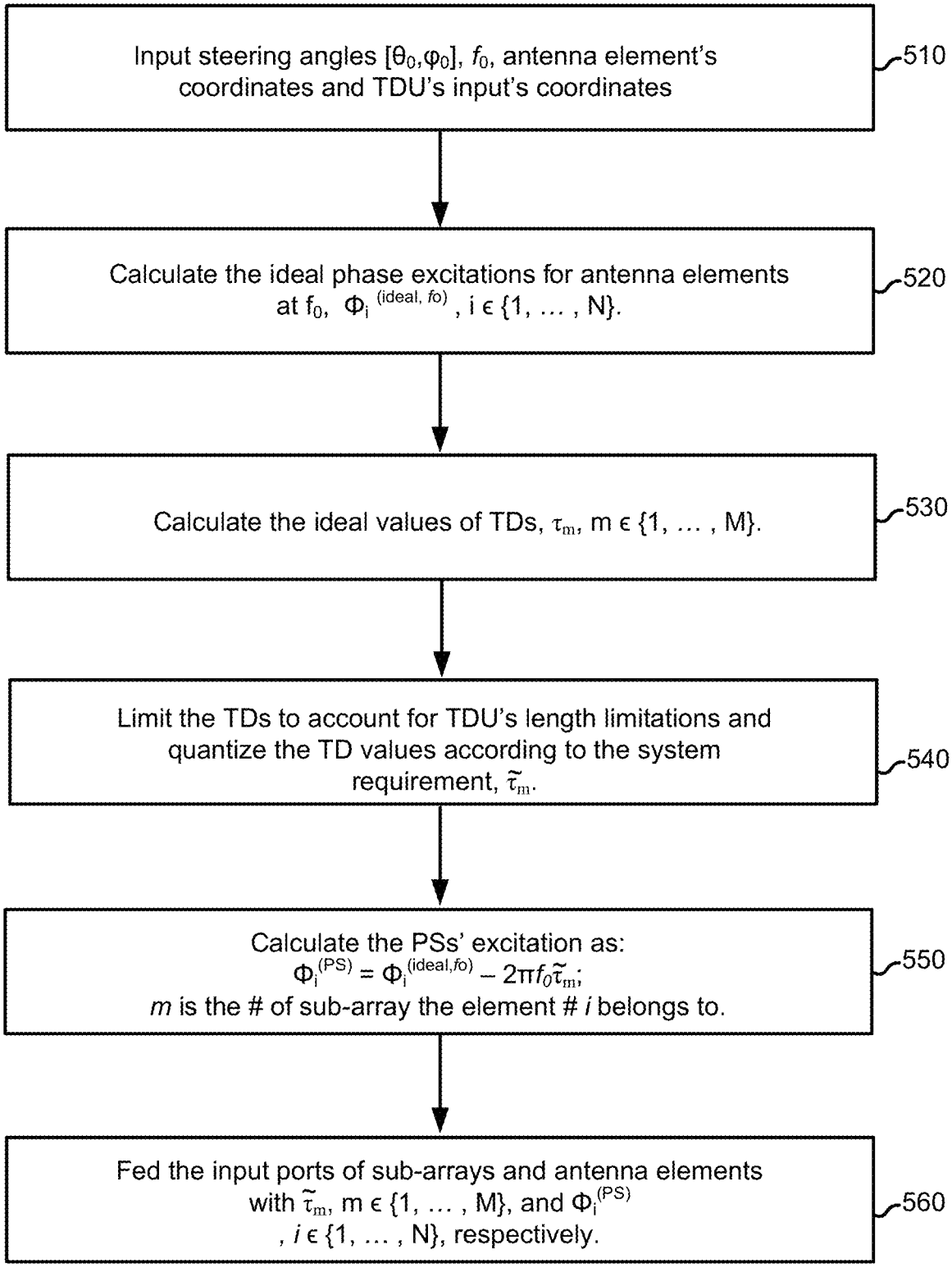
FIG. 5 illustrates operations for operating a phased antenna array, according to embodiments of the present disclosure.

FIG. 5 illustrates operations for operating a phased antenna array, according to embodiments of the present invention. The operations can be performed for each phase shifter and for each TDU of each sub-array. A time delay implemented by a TDU is referred to as a TD. At 510, the steering angles of elevation ($\theta_0$) and azimuth ($\varphi_0$), frequency $f_0$, co-ordinates of the antenna elements associated with the phase shifters being set, and the TDU inputs' co-ordinates can be provided. The steering angles are desired angles of the beam to be implemented by the phased antenna array. The coordinates of antenna elements and the coordinates of TDU inputs can be coordinates in the y-z plane. For example as in Equation (1) $(y_i,z_i)$ indicates the location coordinates of antenna element i and as in Equation (2) $(y'_m,z'_m)$ indicates the location coordinates of TDU input m.

These values are then used at 520 to calculate the ideal phases to be applied at the antenna elements: $\varphi_i^{(Ideal,f_0)}$; $i\varepsilon\{1, \ldots, N\}$, for example in accordance with Equation (1). Next, or concurrently, at 530, the ideal time delay values to be applied at the TDUs, $\tau_m$, $m\varepsilon\{1, \ldots, N\}$ are calculated, for example in accordance with Equation (2). Then at 540 the TDUs' lengths are limited and the TDUs' values are quantized according to the system's requirements, to determine the time delays as actually applied by the TDUs, denoted by $\tilde{\tau}_m$. That is, taking into account limitations of the TDUs, the values $\tilde{\tau}_m$ are determined based on the values $\tau_m$. For example, $\tilde{\tau}_m$ can be taken as the closest achievable approximation to $\tau_m$. At this point, the values $\tilde{\tau}_m$ can be used to drive the respective TDUs (which is done at 560).

Next at 550 the $i^{th}$ PS's phase shift is calculated as: $\varphi_i^{(PS)}=\varphi_i^{(Ideal,f_0)}-2\pi f_0\tilde{\tau}_m$, where m is the sub-array to which the $i^{th}$ PS belongs. This is done for all phase shifters. At this point, the values $\varphi_i^{(PS)}$ can be used to drive the respective phase shifters (which is done at 560). At 560 input ports of sub-arrays and antenna elements are fed, and the TDUs and PSs are operated using values $\tilde{\tau}_m$, $m\varepsilon\{1, \ldots, M\}$ and $\phi_i^{(PS)}$, $i\varepsilon\{1, \ldots, N\}$ respectively.

Figure 6:
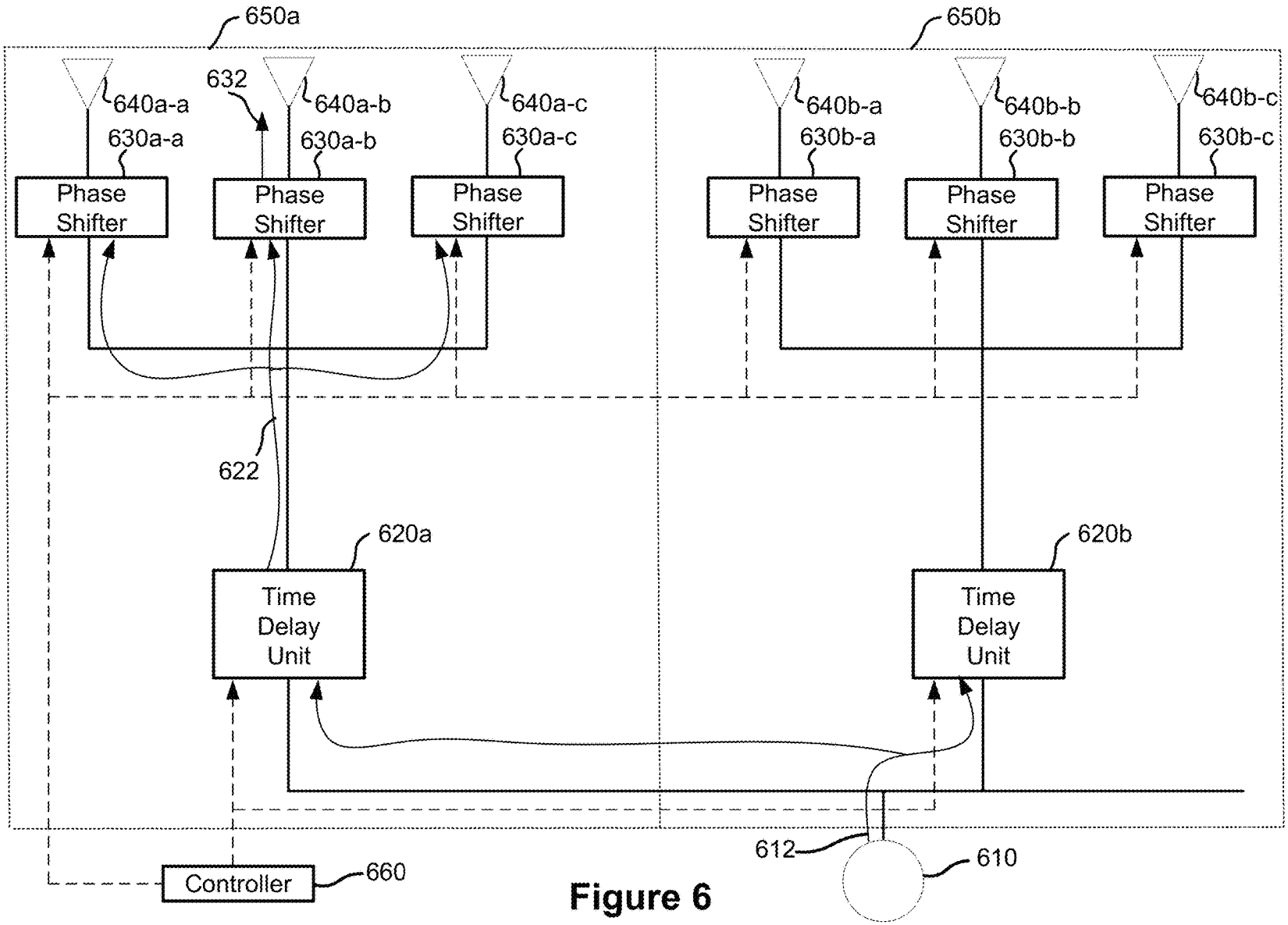
FIG. 6 illustrates an apparatus provided in accordance with embodiments of the present disclosure.

FIG. 6 illustrates a portion of an apparatus provided in accordance with embodiments of the present invention. The apparatus facilitates beamforming and beam squint mitigation in a (typically wideband) wireless communication device. The term "wideband" is used herein to indicate that the communication signal bandwidth is such that beam squint is a potential issue unless compensated for. In various embodiments, but without necessarily limiting the present invention, the term "wideband" can indicate more conventionally that the radio channel's operational bandwidth can significantly exceed the coherence bandwidth of the channel. For clarity purposes, FIG. 6 is described primarily with respect to a transmit function. However, it should be understood that, in some embodiments, the apparatus can additionally or alternatively perform a receive function. In the transmit and receive cases, the same time delays and phase shifts are applied, but the flow of signals is reversed. For example, for the receive function, the direction of arrows 612, 622, 632 is reversed. For the receive function, the internal signal node 610 acts as a signal receiver, which processes the combination of signals as received from multiple time delay units. The internal signal node may comprise a signal source, a signal receiver, or a transceiver, or a combination thereof. The internal signal node can include a power amplifier, a low noise amplifier, or other components as would be readily understood by a worker skilled in the art.

Continuing with FIG. 6 with respect to the transmit function, an internal signal node 610 acts as a signal source and provides a signal 612 as input to time delay units 620*a*, 620*b*. Each of the time delay units 620*a*, 620*b* receives the signal 612 and applies a respective controllable amount of time delay to the signal 612 to produce, as its output (e.g. output 622) a respective time-delayed version of the signal 612. The time-delayed version of the signal is substantially the same as the signal except that it is delayed in time.

More generally, for both the transmit and receive functions, each time delay unit applies a respective controllable amount of time delay to signals provided thereto. For the receive function, each of the time delay units receives reception signals from one, two or more of the phase shifters (as obtained from respective antenna elements) and provides time-delayed versions of these reception signals toward the internal signal node 610.

Also illustrated are phase shifters 630*a-a*, 630*a-b*, 630*a-c*, 630*b-a*, 630*b-b*, 630*b-c*, each operatively coupled to one of the time delay units 620*a*, 620*b*. For the transmit function, each phase shifter is configured to apply a respective controllable amount of phase shift to its own received copy of the time-delayed version of the signal, to produce a respective phase-shifted and time-delayed version of the signal. Each phase shifter then outputs its phase-shifted and time-delayed version of the signal toward a respective antenna element 640*a-a*, 640*a-b*, 640*a-c*, 640*b-a*, 640*b-b*, 640*b-c* of an antenna array. Each antenna element is typically substantially co-located with the phase shifter which provides the signal to that antenna element.

For example, time delay unit 620*a* provides its time-delayed version 622 of the signal 612 to phase shifters 630*a-a*, 630*a-b*, 630*a-c*. Phase shifter 630*a-a* receives the time-delayed version 622 of the signal 612 and applies a controllable amount of phase shift to produce a phase-shifted and time-delayed version 632 of the signal, which is provided to antenna element 640*a-b*.

More generally, for both the transmit and receive functions, each phase shifter applies its controllable amount of phase shift to a signal received by that phase shifter. For the transmit function, the signal is received from one of the time delay units as illustrated. For the receive function, the signal is received from the respective antenna element which is coupled to the phase shifter, and provided toward one of the time delay units which is operatively coupled to that phase shifter.

For each of the phase shifters, the controllable amount of phase shift being applied is set accounting for the respective controllable amount of time delay, as actually applied by the one of the time delay units which is coupled to that phase shifter. For example, phase shifters 630*a-a*, 630*a-b*, 630*a-c* are set accounting for the time delay as applied by time delay unit 620*a*. It is noted that each of the phase shifters, e.g. 630*a-a*, 630*a-b*, 630*a-c*, typically may apply different amounts of phase shift, even when coupled to the same time delay unit. For the transmit function, the time delay unit coupled to a phase shifter is the time delay unit which provides a signal to the phase shifter. For the receive function, the time delay unit coupled to a phase shifter is the time delay unit which receives a signal from the phase shifter.

Setting an amount of phase shift accounting for the time delay applied by an associated time delay unit can include setting the phase shift to compensate for the non-ideality of the time delay unit. In other words, setting the amount of phase shift accounting for the time delay as actually applied by the TDU has the effect of compensating for the non-ideality of the TDU. The phase shift can be set to an ideal value of phase shift to be applied, minus the amount of phase shift actually applied by the non-ideal time delay unit. This indication of the amount of phase shift actually applied can be a value internally generated by a controller.

FIG. 6 further illustrates a controller 660. Controller 660 which may be centralized or which may be formed from a collection of decentralized electronic control elements, is operatively coupled to the time delay units 620*a*, 620*b*, as well as to the phase shifters 630*a-a*, 630*a-b*, 630*a-c*, 630*b-a*, 630*b-b*, 630*b-c*. In particular, the controller is configured to set the amounts of time delays applied by the time delay units and to set the amounts of phase shifts applied by the phase shifters, noting that each time delay unit can apply a separately controllable amount of time delay, and each phase shifter can apply a separately controllable amount of phase shift. In particular, the controller 660 can set the amounts of phase shift, in a phase shifter, accounting for the controllable amounts of time delay as actually applied by the time delay unit which is coupled to that phase shifter. This capability can be used to compensate for limitations of the time delay units, such as the time delay unit only being capable of applying time delays between a predetermined maximum amount and a predetermined minimum amount, the time delay unit only being capable of applying time delays belonging to a predetermined discrete, quantized set, or a combination of these two limitations. Because the controller controls the time delay units, it has ready access to the information regarding what time delays are actually applied. This information can then be used in controlling the phase shifters.

FIG. 6 shows components arranged to support two sub-arrays 650*a*, 650*b* of an overall antenna array. Each sub-array includes its own antennas and phase shifters, with all phase shifters of a given sub-array being coupled to a same single time delay unit. Each sub-array may have its own dedicated time delay unit. FIG. 6 illustrates a tree-like configuration, in which an internal signal node 610 is coupled to multiple TDUs (one per each of a plurality of sub-arrays), and each TDU is in turn operatively coupled to multiple phase shifters (one per antenna element). More particularly, each TDU is operatively coupled to a respective subset of an overall plurality of phase shifters. Further, each TDU, in combination with its subset of phase shifters, is operatively coupled to a different one of the plurality of sub-arrays.

Accordingly, for transmission operation, each of the TDUs receives signals for transmission directly or indirectly from a common source (the internal signal node 610) and provides a time-delayed version of the signal for transmission to two or more of the phase shifters. For reception operation, each of the TDUs receives reception signals from two or more of the phase shifters and provides time-delayed versions of each of the reception signals toward a common receiver (the internal signal node 610).

Although only two time delay units, six total phase shifters and antennas, and two sub-arrays are shown in FIG. 6, it should be readily appreciated that additional time delay units, phase shifters, antennas, and sub-arrayed can be included and operated similarly.

Figure 7:
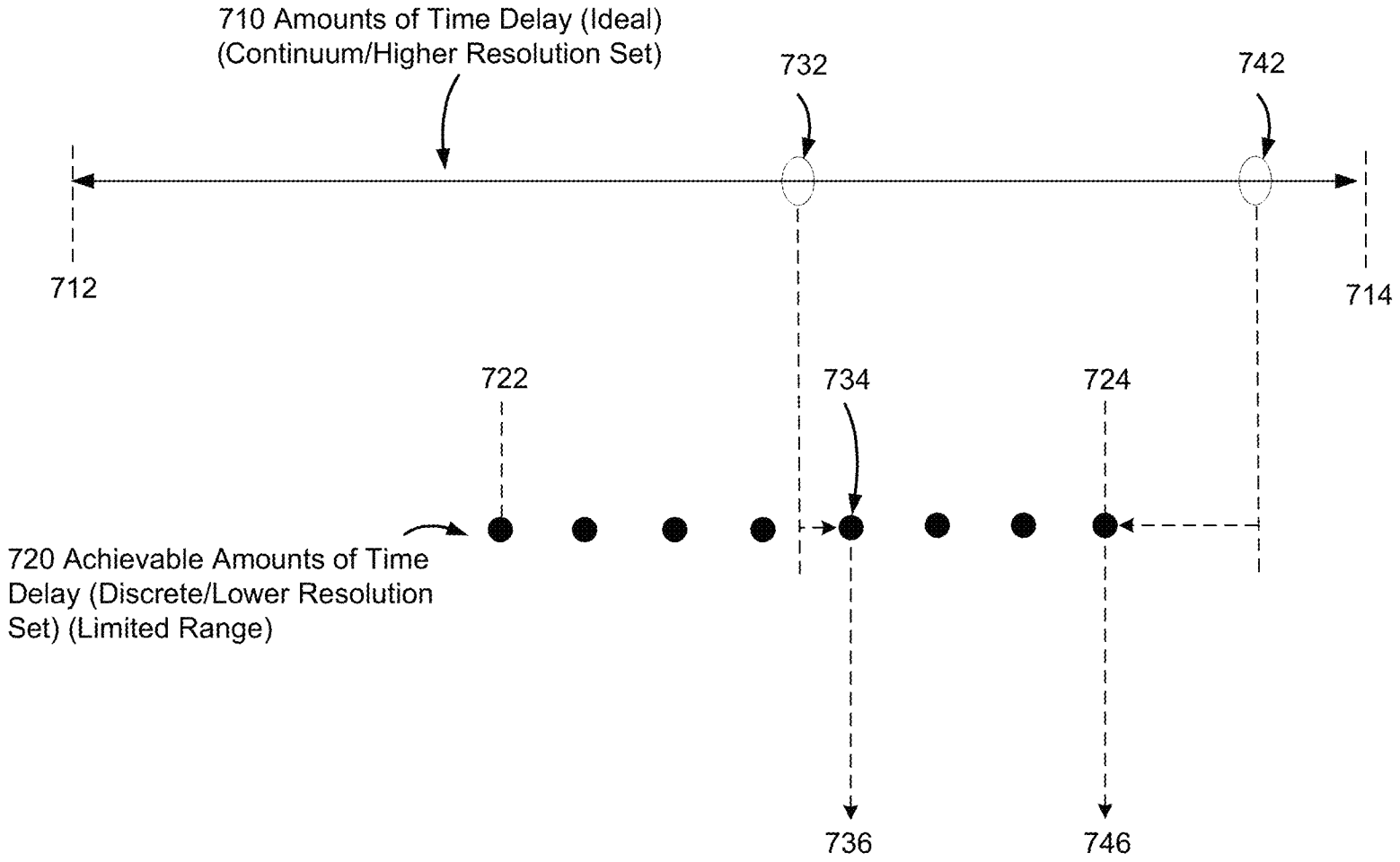
FIG. 7 illustrates operating limitations of a time delay unit in accordance with embodiments of the present disclosure.

FIG. 7 illustrates limitations of a time delay unit, in accordance with embodiments of the present invention. Line 710 represents an idealized range of theoretical time delay values that might be called for in operating an antenna array. The time delay values of line 710 are a continuum of values ranging between a minimum value 712 and a maximum value 714. Alternatively, there may be no set minimum or maximum. It is also noted that a continuum of values might be replaced with a discrete set of values, where the resolution between values in this discrete set is high (the inter-element spacing is small) compared to the resolution in the set of achievable amounts of time delay 720 as discussed below.

A set of points 720 is shown to represent the set of achievable amounts of time delay that can actually be applied by the time delay unit. Because of physical limitations, the time delay unit can only apply time delays between a minimum value 722 (minimum amount) and a maximum value 724 (maximum amount). Notably, the minimum value 722 is greater than the minimum value 712 and the maximum value 724 is less than the maximum value 714. Therefore, it is possible that in some cases the time delay unit cannot implement time delays over the entire range of time delays which might ideally be called for. In other words, an ideal amount of time delay may be greater than the maximum amount or less than the minimum amount, and in such cases the achievable approximation may be limited to the maximum or minimum amount, respectively.

In an alternative embodiment, the minimum value 722 is greater than the minimum value 712 but the maximum value 724 is not necessarily less than the maximum value 714. In another alternative embodiment, the minimum value 722 is not necessarily greater than the minimum value 712 but the maximum value 724 is less than the maximum value 714.

The set of points 720 is discrete and includes a limited number of values (e.g. 8 values in the present illustrated embodiment). This may be due to physical limitations of the time delay unit, along with the use of digital control, which is only capable of specifying discrete values of time delay. Accordingly, the achievable amounts of time delay can be values belonging to a discrete, quantized set, which may not include all ideal target amounts of time delay.

Because of the above physical limitations, although it may be desired for a time delay unit to apply a given ideal target amount of time delay, the time delay unit may only be capable of applying an achievable approximation to the ideal target amount of time delay. The approximation may be the point in the set 720 which is closest to the ideal target amount of time delay. For example, the ideal target amount of time delay 732 does not fall within the set 720, and therefore the value 734 is selected as the closest achievable approximation to 732. The time delay unit may then be set 736 to apply the amount of time delay corresponding to value 734. As another example, the ideal target amount of time delay 742 does not fall within the set 720, and in fact is outside of the range of this set (742 is greater than the maximum value 724). Therefore, the value 724 is selected as the closest achievable approximation to 742. The time delay unit may then be set 746 to apply the amount of time delay corresponding to value 724. The time delay actually applied by the time delay unit is typically set to the achievable approximation to the ideal target amount of time delay.

Notably, in view of FIG. 7, the time delay unit in many cases cannot apply the ideal target amount of time delay, but only an achievable approximation which is unequal to the ideal target amount. It has been recognized by the inventors that, if the phase shifters were controlled based on the ideal target amount of time delay, additional error can be introduced. Therefore, in order to improve beamforming, embodiments of the present invention control the phase shifters based on the amounts of time delay that are actually applied by the time delay units. These amounts of time delay belong to the set 720.

Figure 8A:
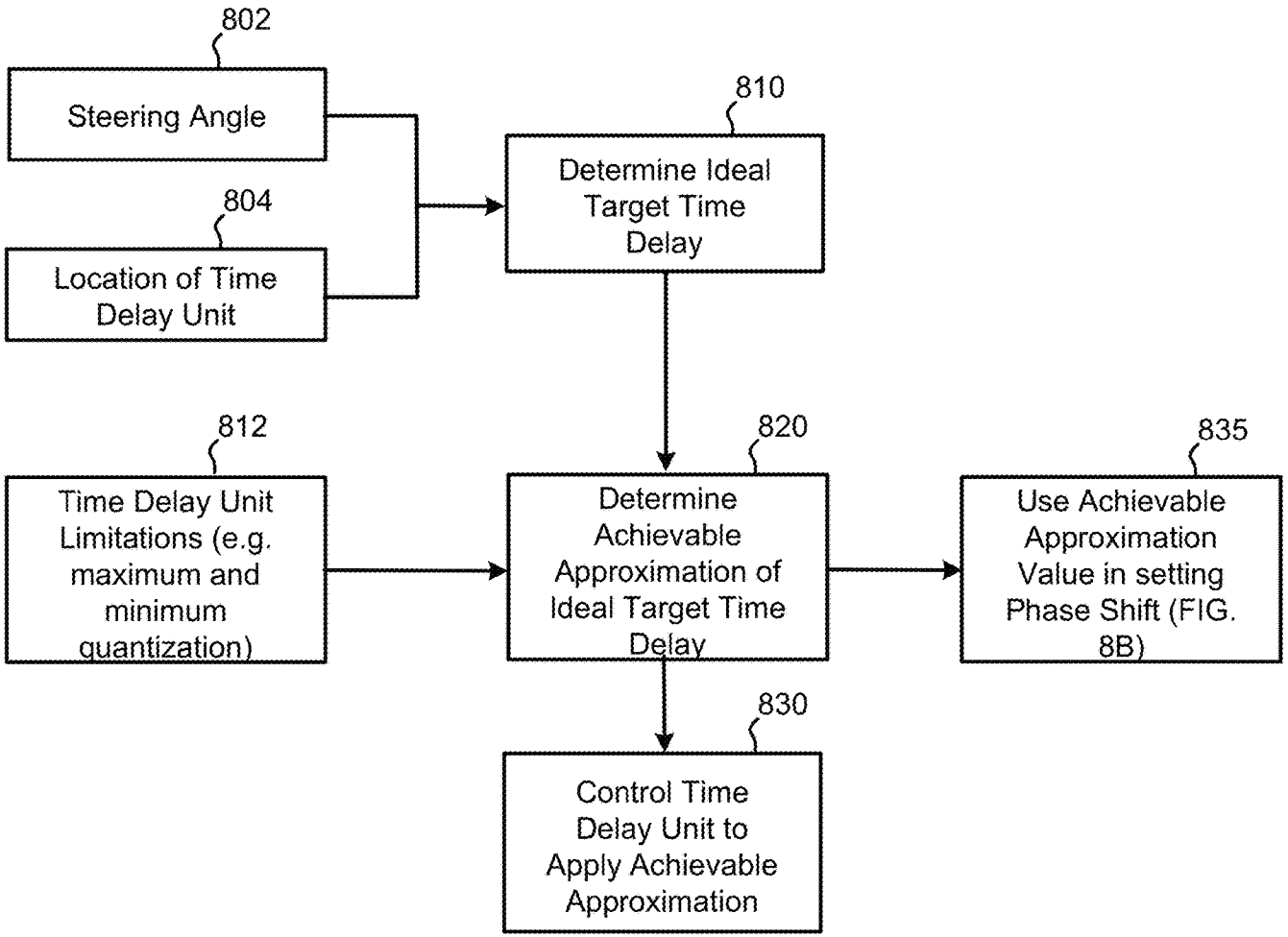
FIG. 8A illustrates operations for controlling a time delay unit according to an embodiment of the present disclosure.

FIG. 8A illustrates operations for controlling a time delay unit, according to an embodiment of the present invention. A desired beamsteering angle 802 and a location of the time delay unit, within the antenna array 704 are provided. The location can be a two-dimensional Cartesian coordinate, for example, and the beamsteering angle can be a one-dimensional or two-dimensional value based on current beamsteering requirements. Depending on the array structure, we may have one dimensional or two dimensional beam steering angle. Linear arrays and planar arrays have one dimensional and two dimensional beam steering angels, respectively. From this, an ideal target amount of time delay is determined

810 for the time delay unit. The determination may be made according to Equation 2, for example. Based on this, an achievable approximation of the ideal target time delay can be determined 820, for example in accordance with the procedure shown in FIG. 7. Equation (3) represents this. The determinations 810 and 820 can be made separately or together in a combined determination operation. The achievable amount of time delay can be limited to a predetermined range of values and quantized, for example. The value determined in 820 can be used to control 830 the time delay unit, by operating the time delay unit to apply the achievable approximation of the ideal target time delay. Additionally, the value determined in 820 can be used 835 in setting phase shifters which are fed by this time delay unit (e.g. phase shifters belonging to the same sub-array as the time delay unit). This operation 835 is described in more detail with respect to FIG. 8B.

Figure 8B:
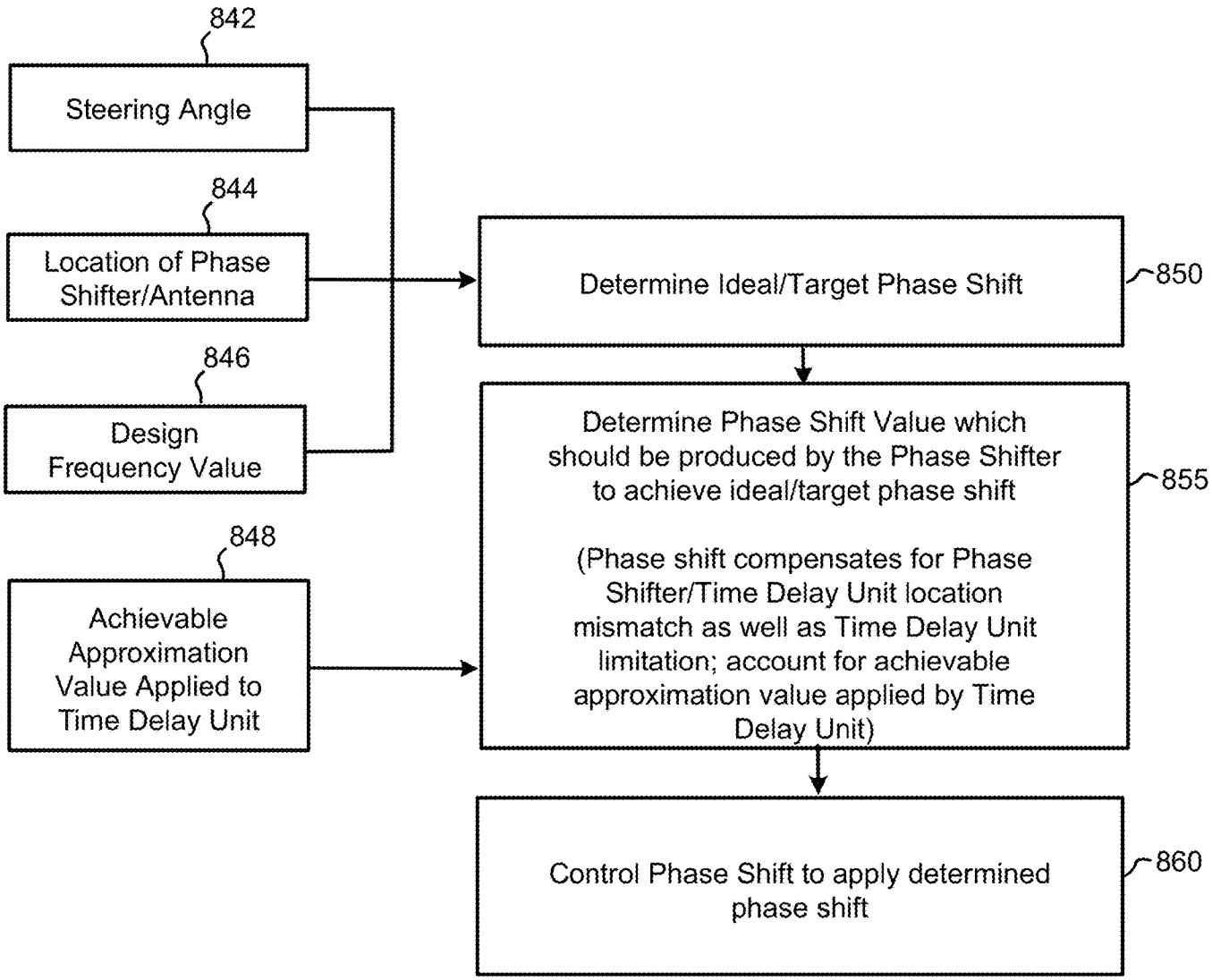
FIG. 8B illustrates operations for controlling a phase shifter according to an embodiment of the present disclosure.

In FIG. 8B, a phase shifter is controlled to apply a desired amount of phase shift. A desired beamsteering angle 842 and a location of the phase shifter (or its corresponding antenna), within the antenna array 844 are provided. Also provided 846 is the design frequency of the array. Based on this, an ideal target amount of phase shift at the design frequency is determined 850, for example as described in Equation 1. Equation 1 represents the ideal target amount of phase shift to be applied at the antenna element that is coupled to the phase shifter. Based on this, the phase shift value which should be applied by the phase shifter is determined 855. This phase shift value determined at 855 compensates for the time delay as actually applied by the time delay unit that feeds the phase shifter. As such, the determination depends on the value 848 representing the achievable approximation of time delay as described with respect to FIG. 7A. The determination 855 can be performed according to Equation 4 for example. This phase shift value in 855 is determined in order to produce or approximately produce the ideal target amount of phase shift determined in 850. The value determined in 855 is used in 860 to control the phase shifter to apply a determined phase shift.

It is noted that, according to embodiments of the present invention, phase shifters are operated to compensate for location mismatch between TDUs and antenna elements, and also to compensate for TDU limitations (practical impairments), such as length limitations and quantization limitations. To compensate for TDU deficiencies, the PSs' excitations are revised according to the actual amounts of time delay applied by the TDUs. First, the desired phase shift of each antenna element is calculated at a design frequency according to the location of that antenna element. Then, the phase shift corresponding to each PS is derived by subtracting the phase shift actually caused by the TDU from the previously calculated desired phase shift. With this approach, each element's PS compensates for not only the location mismatch between that element and the corresponding sub-array input but also the TDs' length limitation and quantization limitation.

It is also noted that embodiments of the present invention can be used with arrays of arbitrary shape. For example, the arrays can include a plurality of sub-arrays arranged according to a regular structure (e.g. as in FIG. 2A which shows a regular arrangement of sub-arrays) or a plurality of sub-arrays arranged according to an irregular structure (e.g. as in FIG. 2B which shows an irregular arrangement of sub-arrays). As further examples, the antenna arrays can be uniform antenna arrays, non-uniform antenna arrays, rectangular antenna arrays, linear antenna arrays, or circular antenna arrays. Embodiments of the present invention can be combined with amplitude tapering of various types.

Embodiments of the present invention can be used for beam squint mitigation with time-delayed sub-array structures in antenna array systems such as but not limited to general wideband phased array systems, linear antenna array systems, rectangular antenna array systems, mmWave communications systems, and radar systems.

Although the present disclosure has been described with reference to specific features and embodiments thereof, it is evident that various modifications and combinations can be made thereto without departing from the disclosure. The specification and drawings are, accordingly, to be regarded simply as an illustration of the disclosure as defined by the appended claims, and are contemplated to cover any and all modifications, variations, combinations or equivalents that fall within the scope of the present disclosure.

We claim:

1. An apparatus facilitating beamforming to mitigate beam squint effect in a wideband wireless communication device, comprising:

one or more time delay units each configured to apply a respective controllable amount of time delay to signals provided thereto; and one or more phase shifters each operatively coupled between a corresponding one of the time delay units and a respective one of antenna elements of an antenna array, each of the phase shifters configured to apply a respective controllable amount of phase shift to signals as received from said one of the time delay units or as received from the respective one of the antenna elements, wherein:

each one of the antenna elements is associated with a respective target amount of time delay to be applied to signals provided thereto or received therefrom;

the target amount of time delay differs from all members of a set of achievable amounts of time delay which can be applied by one of the time delay units operatively coupled to said one of the antenna elements;

said one of the time delay units is configured to approximate the target amount of time delay by applying an actual amount of time delay as a selected member of the set of achievable amounts of time delay; and one of the phase shifters operatively coupled between said one of the antenna elements and said one of the time delay units is configured to apply an amount of phase shift which compensates for a difference between the target amount of time delay and the actual amount of time delay.

2. The apparatus of claim 1, wherein the set of achievable amounts of time delay are limited to being between a predetermined maximum amount and a predetermined minimum amount, and wherein the target amount of time delay is greater than the predetermined maximum amount or less than the predetermined minimum amount.

3. The apparatus of claim 1, wherein the set of achievable amounts of time delay is a predetermined discrete, quantized set, and wherein the target amount of time delay is a value not belonging to said discrete, quantized set.

4. The apparatus of claim 1, further comprising a controller configured to determine, based at least in part on the target amount of time delay: the actual amount of time delay and the amount of phase shift which compensates for the difference between the target amount of time delay and the actual amount of time delay, the controller further configured to control the controllable amounts of time delay of the one or more time delay units and to control the controllable amounts of phase shift of the one or more phase shifters.

5. The apparatus of claim 1, wherein said amount of phase shift which compensates for the difference between the target amount of time delay and the actual amount of time delay is further set based in part on a physical location of the respective one of the antenna elements coupled to the phase shifter.

6. The apparatus of claim 1, wherein:

for each of the time delay units, said controllable amount of time delay is set based on a physical location of said one of the time delay units in combination with a target beamsteering angle of the wireless communication device; and for each of the phase shifters, said controllable amount of phase shift is set based on a physical location of said one of the phase shifters in combination with the target beamsteering angle, further in combination with a design frequency of the wireless communication device, and further in combination with said respective controllable amount of time delay as actually applied by said one of the time delay units.

7. The apparatus of claim 1, wherein the one or more phase shifters is a plurality of phase shifters, and wherein each of the time delay units receives signals for transmission directly or indirectly from a common source and provides a time-delayed version of the signal for transmission to two or more of the phase shifters, or wherein each of the time delay units receives reception signals from two or more of the phase shifters and provides time-delayed versions of each of the reception signals toward a common receiver.

8. The apparatus of claim 1, wherein the one or more time delay units is a plurality of time delay units, the one or more phase shifters is a plurality of phase shifters, each one of the time delay units is operatively coupled to a respective subset of the plurality of phase shifters, the antenna array comprises a plurality of sub-arrays, and each one of the time delay units, in combination with the respective subset of phase shifters operatively coupled thereto, is operatively coupled to a different one of the plurality of sub-arrays.

9. The apparatus of claim 8, wherein the plurality of sub-arrays are arranged according to a regular structure.

10. The apparatus of claim 8, wherein the plurality of sub-arrays are arranged according to an irregular structure.

11. The apparatus of claim 1, wherein the antenna array is a uniform antenna array, a non-uniform antenna array, a rectangular antenna array, a linear antenna array, or a circular antenna array.

12. A controller facilitating beamforming in a wireless communication device, the controller comprising one or more electronic components and configured to:

cause one or more time delay units to apply a respective controllable amount of time delay to signals provided thereto; and cause one or more phase shifters, each operatively coupled between a corresponding one of the time delay units and a respective one of antenna elements of an antenna array, to apply a respective controllable amount of phase shift to signals as received from said one of the time delay units or as received from the respective one of the antenna elements, wherein:

each one of the antenna elements is associated with a respective target amount of time delay to be applied to signals provided thereto or received therefrom;

the target amount of time delay differs from all members of a set of achievable amounts of time delay which can be applied by one of the time delay units operatively coupled to said one of the antenna elements;

the controller is configured to cause said one of the time delay units to approximate the target amount of time delay by applying an actual amount of time delay as a selected member of the set of achievable amounts of time delay; and the controller is further configured to cause one of the phase shifters, operatively coupled between said one of the antenna elements and said one of the time delay units, to apply an amount of phase shift which compensates for a difference between the target amount of time delay and the actual amount of time delay.

13. The controller of claim 12, wherein the members of the set of achievable amounts of time delay differ from the target amount of time delay due at least in part to one or both of:

the time delay unit only being capable of applying time delays between a predetermined maximum amount and a predetermined minimum amount; and the time delay unit only being capable of applying time delays belonging to a predetermined discrete, quantized set.

14. The controller of claim 12, wherein the controller is a centralized controller or a decentralized controller.

15. A method comprising, in a wireless communication device:

causing one or more time delay units to apply a respective controllable amount of time delay to signals provided thereto; and causing one or more phase shifters, each operatively coupled between a corresponding one of the time delay units and a respective one of antenna elements of an antenna array, to apply a respective controllable amount of phase shift to signals as received from said one of the time delay units or as received from the respective one of the antenna elements, wherein:

each one of the antenna elements is associated with a respective target amount of time delay to be applied to signals provided thereto or received therefrom;

the target amount of time delay differs from all members of a set of achievable amounts of time delay which can be applied by one of the time delay units operatively coupled to said one of the antenna elements;

the method further comprises causing said one of the time delay units to approximate the target amount of time delay by applying an actual amount of time delay as a selected member of the set of achievable amounts of time delay; and the method further comprises causing one of the phase shifters, operatively coupled between said one of the antenna elements and said one of the time delay units, to apply an amount of phase shift which compensates for a difference between the target amount of time delay and the actual amount of time delay.

16. The method of claim 15, further comprising:

by each of the one or more time delay units: receiving said signals; applying the respective controllable amount of time delay to each of said signals provided thereto; and producing, as output, time-delayed versions of said signals provided thereto; and by each of the one or more phase shifters: applying the respective controllable amount of phase shift to said signals as received from said one of the time delay units or as received from the respective one of the antenna elements; and outputting phase-shifted versions of said signals as received from said one of the time delay units or as received from the respective one of the antenna elements.

17. The method of claim 15, wherein the members of the set of achievable amounts of time delay differ from the ideal target amount of time delay due at least in part to one or both of:

the time delay unit only being capable of applying time delays between a predetermined maximum amount and a predetermined minimum amount; and the time delay unit only being capable of applying time delays belonging to a predetermined discrete, quantized set.

18. The method of claim 15, further comprising:

determining, based at least in part on the target amount of time delay: the actual amount of time delay and the amount of phase shift which compensates for the difference between the target amount of time delay and the actual amount of time delay; and controlling the controllable amounts of time delay of the one or more time delay units and controlling the controllable amounts of phase shift of the one or more phase shifters.

19. The method of claim 15, wherein said controllable amount of phase shift which compensates for the difference between the target amount of time delay and the actual amount of time delay is further set based on a combination of a first term and a second term, wherein the first term is set based in part on a physical location of the respective antenna element coupled to the phase shifter, and the second term is set to compensate for said respective controllable amount of time delay as actually applied by said corresponding one of the time delay units.

20. The method of claim 15, wherein:

for each of the time delay units, said controllable amount of time delay is set based on a physical location of said one of the time delay units in combination with a target beamsteering angle of the wireless communication device; and for each of the phase shifters, said controllable amount of phase shift is set based on a physical location of said one of the phase shifters in combination with the target beamsteering angle, further in combination with a design frequency of the wireless communication device, and further in combination with said respective controllable amount of time delay as actually applied by said one of the time delay units.

* * * * *